US007008260B2

(12) United States Patent
Diekmann

(10) Patent No.: US 7,008,260 B2
(45) Date of Patent: Mar. 7, 2006

(54) CROSS-CONNECTOR MEANS FOR ELECTRICAL JUNCTION BOXES AND THE LIKE

(75) Inventor: Torsten Diekmann, Leopoldshöhe (DE)

(73) Assignee: Weidmuller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 10/974,944

(22) Filed: Oct. 28, 2004

(65) Prior Publication Data

US 2005/0095905 A1 May 5, 2005

(30) Foreign Application Priority Data

Nov. 4, 2003 (DE) ..... 203 17 158 U

(51) Int. Cl.
*H01R 31/08* (2006.01)

(52) U.S. Cl. ..... 439/514; 439/511

(58) Field of Classification Search ..... 439/511–514, 439/507, 884

See application file for complete search history.

(56) References Cited

U.S. PATENT DOCUMENTS 3,249,905 A * 5/1966 Ruehlemann ..... 439/189
4,582,377 A * 4/1986 Wilmes ..... 439/514
5,669,788 A * 9/1997 Brockman ..... 439/511
6,524,129 B1 * 2/2003 Cote et al. ..... 439/511
2001/0027050 A1 * 10/2001 Ruiz et al. ..... 439/387

FOREIGN PATENT DOCUMENTS

| | | | |
|---|---|---|---|
| DE | 3625240 | A1 | 1/1988 |
| DE | 44 11 306 | C1 | 5/1995 |
| DE | 195 42 628 | C1 | 11/1995 |
| DE | 101 07 157 | A1 | 8/2001 |
| EP | 0 763 874 | B1 | 8/1999 |
| FR | 2 764 445 | A1 | 12/1988 |

* cited by examiner

*Primary Examiner*—Michael C. Zarroli
(74) *Attorney, Agent, or Firm*—Lawrence E. Laubscher, Sr.; Lawrence E. Laubscher, Jr.

(57) ABSTRACT

An electrical cross-connector arrangement is provided for connecting to an electrical junction box or the like a plurality of connecting terminals, modules or pin-and-socket connectors, including a comb-like member having a plurality of resilient flat finger portions having free ends that extend within corresponding openings contained in a plurality of bus bars, respectively, the free end of each finger portion being twisted about the longitudinal axis of the finger portion, thereby to effect a positive electrical contact between the finger portion and the walls of the bus bar opening, while affording a certain degree of tolerance.

3 Claims, 2 Drawing Sheets

Fig.3a
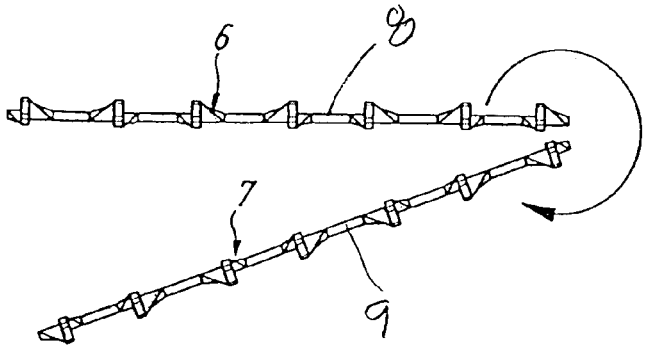
Fig 3b
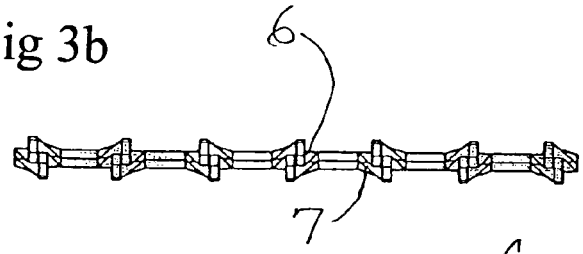
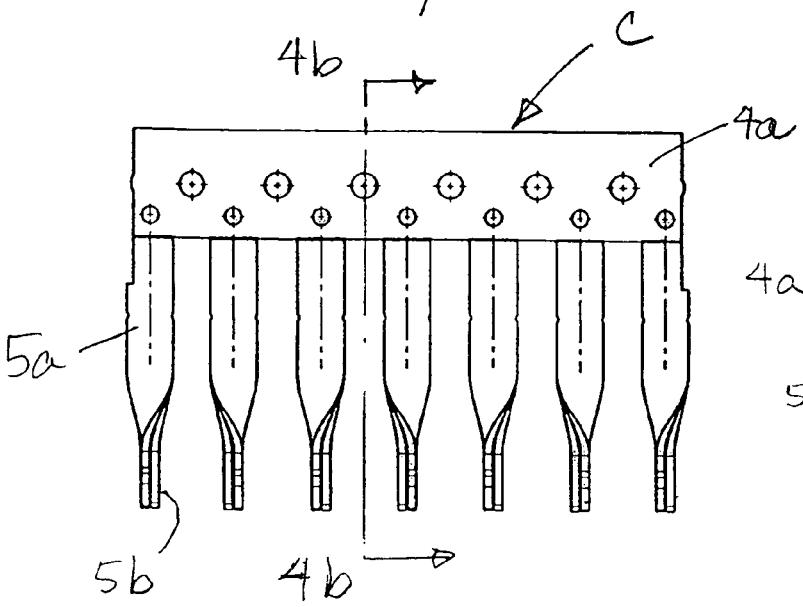
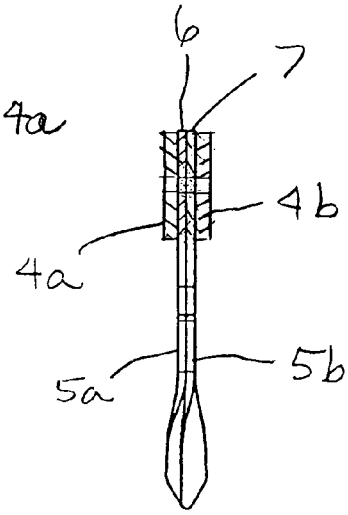
Fig. 4b
Fig. 4a

CROSS-CONNECTOR MEANS FOR ELECTRICAL JUNCTION BOXES AND THE LIKE

BACKGROUND OF THE INVENTION

1. Field of the Invention

A cross-connector arrangement is provided for connecting a plurality of electrical components with a junction box or the like, including a conductive comb-like member having a flat body portion from which extend a plurality of parallel resilient finger portions having free ends which are twisted about the longitudinal axes of the finger portions, respectively, thereby to effect positive electrical engagement—with a certain degree of tolerance—between the finger portions and the walls of bus bar openings within which the free ends extend.

2. Description of the Related Art

As shown by the European patent No. EP 0763874 B1, cross-connectors have been provided in the prior art that offer the advantage that the electrical contact of the bus bars takes place normal to the direction of alignment by means of a pair of resilient contacts that rest upon each other in a planar manner.

The great advantage of this design and the contact normal to the direction of alignment of terminal blocks resides in the fact that geometric changes in the terminal blocks and/or the bus bars due to heat in different climates are compensated for in a simple manner by the existing play of the spring contacts in the bus bar. One must also emphasize here the advantage of a high degree of long-term stability under aggressive atmospheric environmental conditions as well as the high degree of attainable contact safety.

Another advantage resides in the fact that endless cross-connections of up to 50 poles can be made and they can then be made to desired length. As a result of the existing leeway, one can therefore design the cross-connector with many poles.

According to another advantage, the possibility exists of simply taking out individual poles manually by means of preconfigured, required rupture points. Another advantage is represented here by the fact that the contacts consist of planar strips that must be designed relatively thin so that they can be separated at the required rupture points in the simplest fashion.

In the German patent No. 44 11 306 C1, a cross-connector unit of massive structure is proposed wherein the contacting of the recess in the bus bar takes place in each case in the direction of alignment of the terminal blocks. This has the disadvantage that changes in length that are caused by various climates, so to speak, cannot be adjusted. This means that this solution can be used only for particularly short cross-bridge units with only a few connecting plugs.

The present invention was developed to avoid the above problems inherent in the prior art, and to provide an improved cross-connector that provides safe and long-lasting contact with the associated bus bars while at the same time retaining the advantage of tolerance adjustment, particularly, in a direction normal to the alignment direction of the terminal blocks.

BRIEF SUMMARY OF THE INVENTION

Accordingly, a primary object of the present invention is to provide a cross-connector arrangement including a comb-like conductive member having a flat body portion from which extend a plurality of parallel resilient contact fingers, the free end portions of which are twisted about the longitudinal axes of the fingers, thereby to effect electrical contact with wall portions of bus bar openings into which the contact finger free ends extend.

According to another object of the invention, each of the contact fingers comprises a pair of separate layers which, when twisted, are resiliently biased apart into electrical contact with the walls of the non-circular bus bar openings. The contact finger portions of each layer may be formed from a separate sheet having a common portion that connects first ends of the contact fingers. Comb strips are fastened to the external surfaces of the common portion, thereby to strengthen the comb-like member.

The present invention offers the advantage of providing positive electrical contact between the contact fingers and the bus bar openings, while retaining the advantage of a large possible tolerance adjustment. This tolerance adjustment can be even greater when the contact fingers are formed in two separate layers, and the twisting angle of the two contact fingers is about 90° so that the two contact fingers will contact the interior edges of the recess in the bus bar with their side edges. Consequently, the cross-connector units are especially narrow precisely in the contact area in the bus bars, which again means that the possibility of shifting the contact strips or the contact plug in the recess of the bus bar is particularly great in the direction of alignment of the terminal blocks.

BRIEF DESCRIPTION OF THE DRAWINGS

Other objects and advantages of the invention will become apparent from a study of the following specification when viewed in the light of the accompanying drawings, in which:

FIGS. 3*a* and 3*b* illustrate the steps of forming the contact finger portions from separate conductive sheets;

FIG. 4*a* is a side elevational view of the conductive comb member of the present invention; and FIG. 4*b* is a sectional view taken along line 4*b*—4*b* of FIG. 4*a*.

DETAILED DESCRIPTION OF THE INVENTION

Figure 1A:
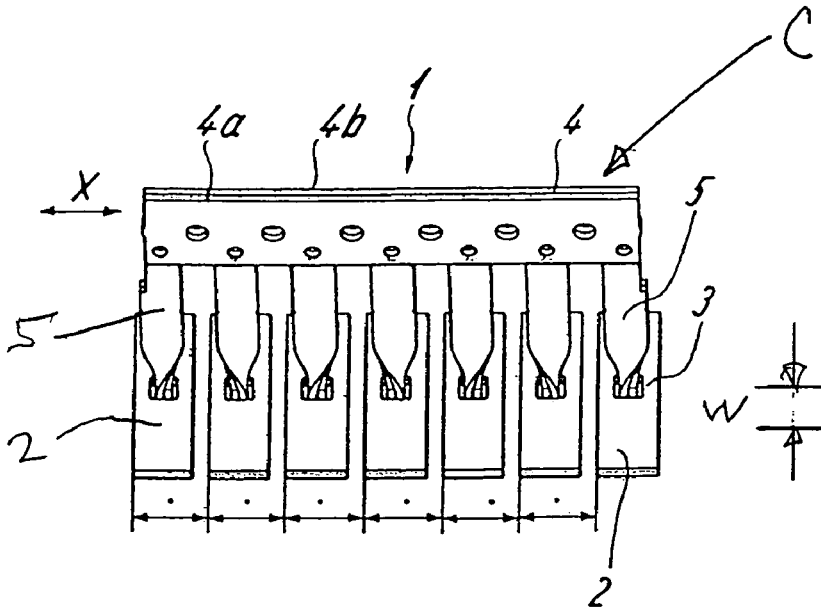
FIG. 1*a* is a perspective view of the cross-connector assembly of the present invention.
Figure 1B:
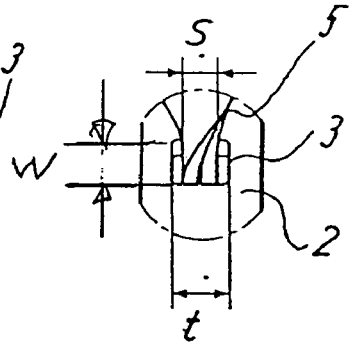
FIG. 1*b* is a detailed view illustrating the contact achieved between the twisted end of the contact finger and the bus bar opening.
Figure 2A:
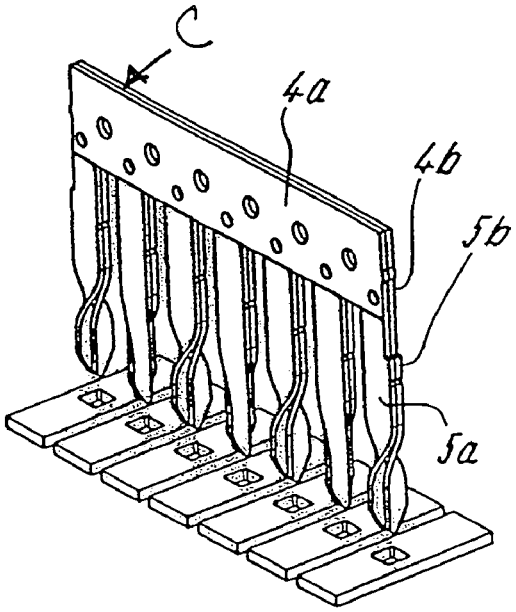
FIG. 2*a* is an exploded perspective view of the contact assembly.
Figure 2B:
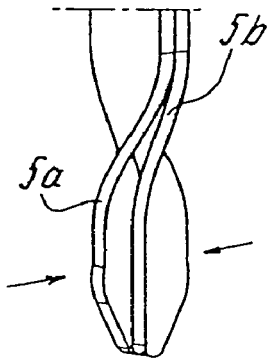
FIG. 2*b* is a detailed view illustrating the separate layers of the twisted end portions of a contact finger.

Referring first more particularly to FIGS. 1*a*–2*b*, the connector assembly 1 of the present invention includes a comb-like member C that is adapted for connection with a plurality of parallel bus bars 2 each containing a connecting opening 3. The cross-connector C includes a body portion 4 that is parallel to the plane of the bus bars 3 and extends in spaced relation above and transversely of the bus bars. Extending downwardly from the comb body portion 4 are a plurality of contact fingers 5, having twisted lower ends that extend within the bus bar openings 3, respectively. The contact fingers have upper ends that are connected with the connector body portion 4, lower ends that are twisted about the longitudinal axes of the contact fingers, respectively. The contact members 5 are preferably formed from a pair of contiguous separate resilient conductive metal sheets 5*a* and 5*b*, respectively, whereby the twisted end portions of each contact finger 5 are resiliently separated, as best shown in FIG. 2*b*. This resilient separation of the layers of the contact finger, together with the twisted lower end portions of the contact fingers, produce positive engagement between the surfaces of the contact finger and the peripheral wall surfaces of the bus bar openings 3, thereby resulting in an improved electrical connection that is constant regardless of the ambient temperature and humidity conditions to which the connector unit is subjected.

Referring to FIG. 1*b*, it will be seen that the width s of the twisted end of the contact finger 5 is less than the corresponding dimension t of the bus bar window opening 3. Preferably, the bus bar windows 3 have a non-circular cross-sectional configuration that is rectangular, with the width dimension w being less than the length dimension t. To strengthen the cross-connector C, the body portion of the connector includes comb strips 4*a* and 4*b* that are secured on opposite sides of the upper end portions of the contact fingers 5. These comb strips 4*a* and 4*b* reinforce the cross-connector structure, and support the upper ends of the resilient contact fingers. The lower end portions of the contact fingers are twisted about the longitudinal axes of the contact fingers through an angle of about 90°, as best shown in FIG. 2*a*. This twisting of the resilient contact finger end portions produces a positive electrical contact between the spring fingers in the walls of the bus bar opening 3. Thus, a considerable degree of tolerance is afforded in the event of variations in ambient temperature, humidity, or pressure conditions. More particularly, the engagement of the contact fingers with the bus bar openings is achieved normal to the axes x of the cross-connector assembly, as best shown in FIGS. 1*a* and 1*b*. In this manner, one can guarantee a safe positive contact between the spring fingers and the bus bars, thereby insuring that the individual contact fingers will engage the walls of the bus bar openings with a favorable t-s tolerance, whereby there will be a certain leeway for tolerance adjustment as a result of material wear or shrinkage produced by temperature fluctuations.

It has furthermore proven to be advantageous when the twist angle varies from contact finger to contact finger. For example, according to the embodiment of FIGS. 1–4, it is provided that every other contact finger could be bent or twisted in a first direction of rotation by 95° and that the other contact fingers located therebetween could be twisted in the opposite direction of rotation by an angle of 90°. This differing angle of twist also provides greater contact safety. Other types of "twist patterns" are possible. For example, it is also possible that the two contact fingers 5, located next to each other, be twisted in one direction by an angle of 90° and by another angle of twist, and that the next contact plugs 5 will be twisted in the opposite direction relative to the longitudinal axes of the contact fingers. The important thing here is that, as a result of the differing directions of twist, one can provide a particularly safe cross-connector arrangement that will, however, be well protected against fatigue and declining resilient force.

Referring now to FIGS. 3*a* and 3*b*, the spring fingers may be formed from a pair of separate conductive sheets 6 and 7, wherein slots 8 are the contact fingers. The free ends of the contact fingers are twisted in the same direction by the same angle, whereby when the conductive metal sheet 6 is pivoted in the direction shown by the arrow in FIG. 3*a*, the two sheets become intermeshed as shown in FIG. 3*b*. Thus, the layers 5*a* and 5*b* of the contact fingers are generally contiguous throughout their length, except for the twisted end portions, which are resiliently separated as shown in FIG. 2*b*. The comb strips 4*a* and 4*b* are secured to the opposite remote surfaces of the contact finger sheets 6 and 7, as shown in FIG. 4*b*. Thus, in spite of the surprisingly effective resilient geometry in the area of the bus bar recesses 3, the cross connector units can be made in a particularly inexpensive and simple manner.

While in accordance with the provisions of the Patent Statutes the preferred forms and embodiments of the invention have been illustrated and described, it will be apparent to those skilled in the art that various changes may be made without deviating from the inventive concepts set forth above.

What is claimed is:

1. Cross-connector means for electrically connecting electrical devices such as junction boxes, terminals, modules, pin-and-socket connectors, and the like, with a plurality of bus bars, comprising:

(a) a plurality of generally coplanar parallel conductive bus bars (2) each having a generally planar portion containing an opening (3), said bus bars being contained in a first plane; and (b) a conductive comb member (C) including:

(1) a generally linear flat body portion (4) that is parallel with and spaced from the plane containing said bus bars, said body portion being contained in a second plane that is normal both to said first plane and to the axes of said bus bars; and (2) a plurality of flat resilient contact finger portions (5) that extend from said body portion in the direction of said bus bars, respectively, each of said finger portions having a longitudinal axis and including a first end portion connected with and parallel to said comb member body portion, and a second end portion that extends into a corresponding one of said bus bars openings, said second end portion being twisted about said longitudinal axis relative to said first end portion, thereby to effect electrical contact with at least one wall portion of said bus bar opening, said second end portion being twisted about said contact finger longitudinal axis through an angle of between 45° and 135° relative to said first end portion, at least some of said contact finger portions being twisted through different angles of twist.

2. Cross-connector means for electrically connecting electrical devices such as junction boxes, terminals, modules, pin-and-socket connectors, and the like, with a plurality of bus bars, comprising:

(a) a plurality of generally coplanar parallel conductive bus bars (2) each having a generally planar portion containing an opening (3), said bus bars being contained in a first plane; and (b) a conductive comb member (C) including:

(1) a generally linear flat body portion (4) that is parallel with and spaced from the plane containing said bus bars, said body portion being contained in a second plane that is normal both to said first plane and to the axes of said bus bars; and (2) a plurality of flat resilient contact finger portions (5) that extend from said body portion in the direction of said bus bars, respectively, each of said finger portions having a longitudinal axis and including a first end portion connected with and parallel to said comb member body portion, and a second end portion that extends into a corresponding one of said bus bars openings, said second end portion being twisted about said longitudinal axis relative to said first end portion, thereby to effect electrical contact with at least one wall portion of said bus bar opening, said second end portion being twisted about said contact finger longitudinal axis through an angle of between 45° and 135° relative to said first end portion, at least some of said contact finger portions being twisted in opposite directions relative to their respective longitudinal axes.

3. Cross-connector means for electrically connecting electrical devices such as junction boxes, terminals, modules, pin-and-socket connectors, and the like, with a plurality of bus bars, comprising:

(a) a plurality of generally coplanar parallel conductive bus bars (2) each having a generally planar portion containing an opening (3), said bus bars being contained in a first plane; and (b) a conductive comb member (C) including:

(1) a generally linear flat body portion (4) that is parallel with and spaced from the plane containing said bus bars, said body portion being contained in a second plane that is normal both to said first plane and to the axes of said bus bars; and (2) a plurality of flat resilient contact finger portions (5) that extend from said body portion in the direction of said bus bars, respectively, each of said finger portions having a longitudinal axis and including a first end portion connected with and parallel to said comb member body portion, and a second end portion that extends into a corresponding one of said bus bars openings, said second end portion being twisted about said longitudinal axis through an angle of between 45° and 135° relative to said first end portion, thereby to effect electrical contact with at least one wall portion of said bus bar opening, each of said contact finger portions comprising a plurality of layers of contact strips (5*a*, 5*b*), said layers being twisted about their longitudinal axes to effect resilient contact of said layers with the wall portions of said bus bar opening, each of said bus bar openings having a generally rectangular cross-sectional configuration, the width (s) of each of said contact finger portions being less than the length (t) of the associated bus bar wall opening.

* * * * *